US012497684B2

(12) United States Patent
Johnson et al.

(10) Patent No.: US 12,497,684 B2
(45) Date of Patent: Dec. 16, 2025

(54) METHODS AND COMPOSITIONS FOR FORMING MAGNETITE COATINGS ON FERROUS METALS

(71) Applicant: Birchwood Laboratories LLC, Eden Prairie, MN (US)

(72) Inventors: Zach D. Johnson, Saint Louis Park, MN (US); Ross Eric Haugberg, Minneapolis, MN (US)

(73) Assignee: Birchwood Laboratories LLC, Eden Prairie, MN (US)

( * ) Notice: Subject to any disclaimer, the term of this patent is extended or adjusted under 35 U.S.C. 154(b) by 712 days.

(21) Appl. No.: 17/873,846

(22) Filed: Jul. 26, 2022

(65) Prior Publication Data

US 2023/0049815 A1 Feb. 16, 2023

Related U.S. Application Data

(60) Provisional application No. 63/226,470, filed on Jul. 28, 2021.

(51) Int. Cl.

| | |
|---|---|
| ***C23C 8/00*** | (2006.01) |
| ***C23C 8/42*** | (2006.01) |
| ***C23C 8/80*** | (2006.01) |

(52) U.S. Cl.

CPC . *C23C 8/42* (2013.01); *C23C 8/80* (2013.01)

(58) Field of Classification Search

CPC ..... C23C 8/42; C23C 8/80
USPC ..... 106/287.26
See application file for complete search history.

(56) References Cited

U.S. PATENT DOCUMENTS

| | | | |
|---|---|---|---|
| 2,148,331 | A | 2/1939 | Mark et al. |
| 2,303,350 | A | 12/1942 | Fuller |
| 2,774,696 | A | 12/1956 | Gibson |
| 2,791,525 | A | 5/1957 | Rausch et al. |

(Continued)

FOREIGN PATENT DOCUMENTS

| | | |
|---|---|---|
| DE | 2623604 | 12/1976 |
| DE | 4217098 | 11/1992 |

(Continued)

OTHER PUBLICATIONS

"Activated Black Magic Plus: The cutting edge for quality and performance when hot black oxiding steel," Hubbard-Hall; Waterbury, CT, at least as early as Apr. 2005 (5 pages).

(Continued)

*Primary Examiner* — James E Mcdonough
(74) *Attorney, Agent, or Firm* — Pauly, DeVries Smith & Deffner LLC

(57) ABSTRACT

The present invention relates to methods and compositions for coating ferrous metal substrates. In an embodiment, the invention includes a composition for forming a magnetite coating on a ferrous metal substrate. The composition comprising an aqueous oxidizing solution. The aqueous oxidizing solution comprising an alkali metal hydroxide, an alkanolamine, and a chloride salt. In an embodiment, the invention includes a method of forming a magnetite coating on a ferrous metal substrate. The method including contacting the ferrous metal substrate with an aqueous oxidizing solution, the aqueous oxidizing solution comprising an alkali metal hydroxide, an alkanolamine, and a chloride salt. Other embodiments are also included herein.

20 Claims, 6 Drawing Sheets

(56) References Cited

U.S. PATENT DOCUMENTS

| | | | |
|---|---|---|---|
| 2,805,969 | A | 9/1957 | Goodspeed et al. |
| 2,817,610 | A | 12/1957 | Newell et al. |
| 2,835,616 | A | 5/1958 | Werner et al. |
| 2,850,417 | A | 9/1958 | Henry et al. |
| 2,960,420 | A | 11/1960 | Mitchell |
| 3,053,691 | A | 9/1962 | Hartman et al. |
| 3,053,692 | A | 9/1962 | Pocock |
| 3,083,149 | A | 3/1963 | Cranston |
| 3,121,033 | A | 2/1964 | Stapleton |
| 3,346,522 | A | 10/1967 | Schuster et al. |
| 3,481,762 | A | 12/1969 | Streicher |
| 3,559,280 | A | 2/1971 | Mailhiot et al. |
| 3,598,659 | A | 8/1971 | Klingler et al. |
| 3,632,452 | A | 1/1972 | Matsushima et al. |
| 3,649,371 | A | 3/1972 | Tongyai |
| 3,658,603 | A | 4/1972 | Boyer |
| 3,677,827 | A | 7/1972 | Weaver et al. |
| 3,706,604 | A | 12/1972 | Plaxton |
| 3,709,742 | A | 1/1973 | Jacobs |
| 3,753,942 | A | 8/1973 | Moran et al. |
| 3,806,375 | A | 4/1974 | McLeod et al. |
| 3,879,237 | A | 4/1975 | Faigen |
| 3,899,367 | A | 8/1975 | Mitchell |
| 3,929,514 | A | 12/1975 | Houlihan et al. |
| 3,936,445 | A | 2/1976 | Pfitzner et al. |
| 4,006,041 | A | 2/1977 | Fabregas et al. |
| 4,017,335 | A | 4/1977 | Maloney |
| 4,018,934 | A | 4/1977 | Parliment |
| 4,086,182 | A | 4/1978 | Hengelhaupt et al. |
| 4,140,551 | A | 2/1979 | Jones |
| 4,199,624 | A | 4/1980 | Smith |
| 4,246,030 | A | 1/1981 | Lipinski |
| 4,296,182 | A | 10/1981 | Matsubayashi et al. |
| 4,298,405 | A | 11/1981 | Saus et al. |
| 4,565,585 | A | 1/1986 | Matsuda |
| 4,591,397 | A | 5/1986 | Jones et al. |
| 4,728,365 | A | 3/1988 | Jarvi |
| 4,781,948 | A | 11/1988 | Caldwell |
| 4,789,409 | A | 12/1988 | Jarvi |
| 4,794,139 | A | 12/1988 | Braden et al. |
| 4,806,161 | A | 2/1989 | Fabiny et al. |
| 4,851,149 | A | 7/1989 | Carandang |
| 4,944,812 | A | 7/1990 | Lindert et al. |
| 5,089,349 | A | 2/1992 | Kaiser |
| 5,104,463 | A | 4/1992 | Menke |
| RE34,272 | E | 6/1993 | Michaud et al. |
| 5,320,872 | A | 6/1994 | McNeel et al. |
| 5,466,297 | A | 11/1995 | Goodman et al. |
| 5,580,063 | A | 12/1996 | Edwards |
| 5,591,275 | A | 1/1997 | Miyafuji et al. |
| 5,601,663 | A | 2/1997 | Rungta et al. |
| 5,667,599 | A | 9/1997 | Rungta et al. |
| 5,704,995 | A | 1/1998 | Bradley |
| 5,723,183 | A | 3/1998 | Williams et al. |
| 5,919,318 | A | 7/1999 | Brands et al. |
| 6,171,409 | B1 | 1/2001 | Hamacher et al. |
| 6,193,815 | B1 | 2/2001 | Wada et al. |
| 6,277,214 | B1 | 8/2001 | Akhtar et al. |
| 6,309,476 | B1 | 10/2001 | Ravenscroft et al. |
| 6,527,873 | B2 | 3/2003 | Ravenscroft et al. |
| 6,576,346 | B1 | 6/2003 | Ravenscroft et al. |
| 6,695,931 | B1 | 2/2004 | Ravenscroft et al. |
| 6,752,878 | B2 | 6/2004 | Montano et al. |
| 6,899,769 | B2 | 5/2005 | Ravenscroft et al. |
| 6,899,956 | B2 | 5/2005 | Block et al. |
| 7,964,044 | B1 | 6/2011 | Block et al. |
| 8,287,663 | B2 | 10/2012 | William et al. |
| 2002/0069900 | A1 | 6/2002 | Evers |
| 2002/0108678 | A1 | 8/2002 | Montano et al. |
| 2003/0079807 | A1 | 5/2003 | Ravenscroft et al. |
| 2011/0308668 | A1 | 12/2011 | Block et al. |

FOREIGN PATENT DOCUMENTS

| | | | |
|---|---|---|---|
| EP | 0264471 | 4/1988 | |
| EP | 0264472 | 4/1988 | |
| JP | S60128288 | 7/1985 | |
| JP | S6427938 | 1/1989 | |
| JP | 1073093 | 3/1989 | |
| JP | S6473093 | 3/1989 | |
| WO | WO-2017188662 A1 * | 11/2017 | ..... A61K 8/553 |

OTHER PUBLICATIONS

"Activated" Black Magic Plus, Hubbard-Hall accessible at http://www.hubbard-hall.com/files/2232001.pdf; Hubbard-Hall, Waterbury, CT, Oct. 1996 (3 pages).

"Dulite's Guide to Hot Black Oxide Processes," The Du-Lite Corporation; Middletown CT; 1994 (5 pages).

File History for U.S. Appl. No. 10/978,087 downloaded Sep. 12, 2022 (502 pages).

File History for U.S. Appl. No. 13/109,786 downloaded Sep. 12, 2022 (142 pages).

"Guide to Room Temperature Antiquing without Hazardous Effluent," Birchwood Casey; Eden Prairie, MN, at least as early as Apr. 2005 (8 pages).

"In-House Blackening with No EPA Regulated Chemicals," Birchwood Casey Brochure; Birchwood Casey; Eden Prairie, MN, at least as early as Apr. 2005 (8 pages).

"In-House Cold Blackening: Your Practical Guide and Cost Analysis," Birchwood Casey; Eden Prairie, MN, Aug. 1997 (12 pages).

"It Doesn't Get Any Blacker Than This," Heatbath Corporation With Supporting Pages From www.heatbath.com/black-oxide-finishing.htm, Finisher's Management et al, Mar. 1996 (14 pages).

"Material Safety Data Sheet: Presto Black Brush-On BST4," Birchwood Laboratories, Eden Prairie, MN, Apr. 2, 2001 (6 pages).

"Safe, Low Cost, In-house Blackening with the Presto Black Process," Birchwood Laboratories, Inc., Eden Prairie, MN, at least as early as Apr. 2005 (6 pages).

"Thioureat—CAS No. 62-56-6," First listed in the Third Annual Report on Carcinogens; Tenth Report on Carcinogens; 2006 (4 pages).

Block, William V. "Thesis: Electroless Blackening of Ferrous Metals: Development of an Environmentally Friendlier Method," Kennedy-Western University, Apr. 2002, pp. 1-182 (182 pages).

Cotton, F. Albert, et al. "Advanced Inorganic Chemistry A Comprehensive Text," Interscience Publishers, NY, 1962, pp. 847-863 (11 pages).

Daniels, Christopher "Black-Oxide Basics: Improved protection, appearance and performance with black oxide finishes," Products Finishing; Jul. 1992 (2 pages).

Godding, A.D. "The Basics of Black Oxide Finishing: Why to do it, how to do it, applications and advantages," Products Finishing; Feb. 1990 (3 pages).

Godding, A.D. "Why Black Oxide? Here's how and why," Products Finishing; Apr. 1986 (3 pages).

Kuznetsov, Yu. I., et al. "Accelerator of Steel Oxidation in Ammonium Nitrate Solutions," Protection of Metals, vol. 40, No. 1, 2004, pp. 3-6 (4 pages).

Kuznetsov, Yu. I., et al. "On the Possibility of Reducing Oxidation Temperature of Low-Carbon Steel in Nitrate Solutions," Protection of Metals and Chemistry of Surfaces, 2010, vol. 46, No. 7, pp. 805-811 (7 pages).

Ruhland, Mark "Blackening of Ferrous Metals," Birchwood Casey and PF Directory; Eden Prairie, MN, 1999 (5 pages).

Vershok, D.B., et al. "On the Formation of Magnetite Coatings on Low-Carbon Steel in Ammonium Nitrate Solution," Protection of Metals, 2008, vol. 44, No. 7, pp. 721-728 (8 pages).

Vershok, D.B., et al. "The Influence of Zinc Cations on Steel Oxidation in Nitrate Solutions," Protection of Metals and Physical Chemistry of Surfaces, 2009, vol. 45, No. 7, pp. 824-828 (5 pages).

* cited by examiner

METHODS AND COMPOSITIONS FOR FORMING MAGNETITE COATINGS ON FERROUS METALS

This application claims the benefit of U.S. Provisional Application No. 63/226,470, filed Jul. 28, 2021, the content of which is herein incorporated by reference in its entirety.

FIELD OF THE INVENTION

The present invention relates to methods and compositions for coating substrates. More specifically, the present invention relates to methods and compositions for forming magnetite coatings on ferrous substrates at relatively low temperatures.

BACKGROUND OF THE INVENTION

The term "metal finishing" generally refers to the application of a desired treatment, texture, or coating to the surface of a metal. Metal finishing processes dedicated to the coating of ferrous metal objects are intended to lend aesthetics, utility, and corrosion protection to the coated metal surface. Desired attributes of metal coatings include good adhesion to the metal surface, coating color retention, wear resistance, and corrosion protection.

One approach to applying a coating is that outlined by Mitchell in U.S. Pat. No. 2,960,420. Mitchell's technology requires highly alkaline solutions using high concentrations of sodium hydroxide (5-8 pounds per gallon), along with oxidizing agents and accelerants, operating at high temperatures (250-290° F.). In actual practice, the process operates most effectively at 285-290° F., which creates a considerable safety hazard for the user in the form of splattering and solution boilover that are commonly encountered as part of normal operation and maintenance of the process line.

Another approach to applying a coating is described in Ravenscroft (U.S. Pat. No. 6,309,476), which specifies a much lower level of alkalinity than Mitchell (1.5 pounds per gallon sodium hydroxide), along with oxidizing salts and accelerants, operating at lower temperatures than Mitchell's technology.

Yet another process, referred to as "cold blackening," involves the deposition of copper selenide coatings from aqueous media on steel and aluminum substrates. An example of this process is described in U.S. Pat. No. 2,303,350. The aqueous solution contains selenium and copper salts and is applied at room temperature by brush, wipe-on and immersion techniques using 7 to 8 process steps.

The coatings produced by the "cold blackening" process offer good color stability but are relatively non-adherent and therefore exhibit poor wear resistance. As such, a sealant, wax or other corrosion protective coating must generally be applied immediately following the blackening process to secure the coating and protect the metal surface. In addition, the selenide coating itself affords no corrosion protection to the metal. Finally, this process presents disposal issues as selenium can be highly toxic at even moderate concentrations. The U.S. Environmental Protection Agency has set a maximum contaminant level (MCL) for selenium of only 0.05 parts per million.

SUMMARY OF THE INVENTION

The present invention relates to methods and compositions for forming a magnetite coating on ferrous metal substrates. In an embodiment, the invention includes a composition for forming a magnetite coating on a ferrous metal substrate. The composition can include an aqueous oxidizing solution. The aqueous oxidizing solution can include an alkali metal hydroxide, an alkanolamine, and a chloride salt.

In an embodiment, the invention includes a composition for forming a magnetite coating on a ferrous metal substrate. The composition can include an aqueous oxidizing concentrate. The aqueous oxidizing concentrate can include an alkali metal hydroxide, an alkanolamine, and a chloride salt.

In an embodiment, the invention includes a method of forming a magnetite coating on a ferrous metal substrate. The method may include contacting the ferrous metal substrate with an aqueous oxidizing solution comprising an alkali metal hydroxide, an alkanolamine, and a chloride salt.

The above summary of the present invention is not intended to describe each discussed embodiment of the present invention. This is the purpose of the figures and the detailed description that follows.

BRIEF DESCRIPTION OF THE FIGURES

The invention may be more completely understood in connection with the following drawings, in which.

While the invention is susceptible to various modifications and alternative forms, specifics thereof have been shown by way of example and drawings, and will be described in detail. It should be understood, however, that the invention is not limited to the particular embodiments described. On the contrary, the intention is to cover modifications, equivalents, and alternatives falling within the spirit and scope of the invention.

DETAILED DESCRIPTION OF THE INVENTION

As described above, various approaches have been used in the past to form a magnetite coating on a ferrous metal substrate. However, these approaches have various drawbacks including poor adherence, tight process control requirements, the use of highly toxic compounds, poor color stability, and/or high temperatures.

The composition and processes of the embodiments described in this specification produce a high quality, chemically bonded magnetite coating on ferrous metal without the drawbacks associated with other processes. By way of example, processes herein can be used at relatively low temperatures and produce a more uniform, deep black magnetite coating.

Embodiments described herein include solutions that are free of regulated metallic compounds such as zinc and aluminum compounds. By way of example, embodiments of solutions used herein include less than 1 ppm of zinc and/or less than 1 ppm of aluminum.

Figure 1:
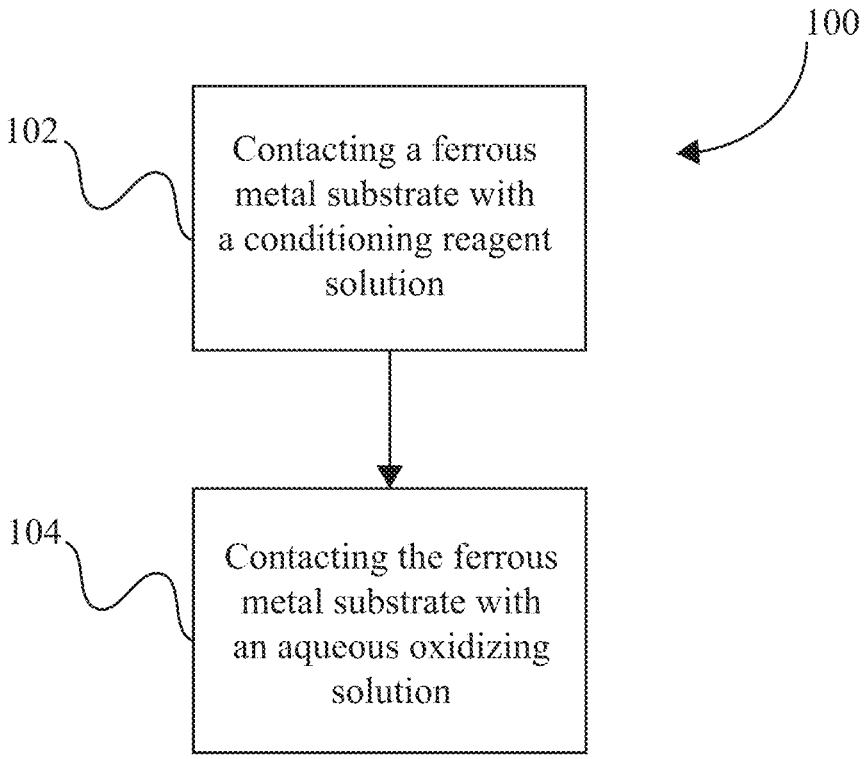
FIG. 1 is a flow chart illustrating a method in accordance with an embodiment of the invention.

Referring now to FIG. 1, a flow chart is shown of a method 100 in accordance with an embodiment herein. In some embodiments, the method 100 can include contacting the ferrous metal substrate with a conditioning reagent solution 102. However, in some embodiments, this step can be omitted. The conditioning reagent solution functions to form a metallic surface on the ferrous metal substrate that is rich in chemically reactive elemental iron. The conditioning reagent solution can remove pre-existing oxide traces on the surface of the metal that can interfere with the formation of a magnetite coating at lower process temperatures and concentrations of embodiments described in this specification. Details of exemplary conditioning reagent solutions are described in greater detail below.

The temperature of the conditioning reagent solution can be greater than 50 degrees Fahrenheit. In some embodiments, the temperature of the conditioning reagent solution is maintained at or above 70 degrees Fahrenheit. In some embodiments, the temperature of the conditioning reagent solution in this embodiment can be about normal room temperature. For example, the temperature of the conditioning reagent solution can be from about 64 to about 75 degrees Fahrenheit. However, in some embodiments, the conditioning reagent solution may be kept at a temperature that is lower or higher than that range. In some embodiments, the conditioning reagent solution is at a temperature of between 64 and about 140 degrees Fahrenheit.

The contact time with the conditioning reagent solution can be an amount of time sufficient to remove oxide traces from the surface of the ferrous metal substrate. In some embodiments, the contact time can be greater than about 10 seconds. In some embodiments, the contact time can be from about 30 seconds to about 15 minutes. In some embodiments, the contact time can be from about 30 seconds to about 10 minutes.

Next, the method 100 can include contacting the ferrous metal substrate with an aqueous oxidizing solution 104. The aqueous oxidizing solution can function to form a black magnetite coating on the surface of the ferrous metal substrate. Prior to application of the aqueous oxidizing solution, the ferrous metal substrate can, in some cases, take on a bright gray color that is a result of the conditioning solution. Regardless, however, application of the aqueous oxidizing solution can cause the ferrous metal substrate to rapidly change in appearance to a uniform, deep black color. In fact, the coating formed on the surface of the ferrous metal substrate passes industry standard tests (MIL-DTL-1392) that demonstrate the durability and uniformity of the color of the coating achieved. For example, the coating can pass an oxalic acid test by showing no deterioration in the coating formed or the deep black color achieved. The coating formed can also pass a smut test by showing no visible residue on the testing paper. The coating formed shows no evidence of surface attack at 10× magnification and no appreciable dimensional change of the ferrous metal substrate. Further details of exemplary aqueous oxidizing solutions are described in greater detail below.

It will be appreciated that exemplary methods can also include other operations. By way of example, in some embodiments, methods can also include pretreatment operations, rinsing operations, top coating and/or sealing operations, and the like. Pretreatment operations can include steps of cleaning, degreasing, descaling, and combinations thereof. These steps can be performed chemically (such as with use of a cleaning solution), mechanically (such as through sanding, scraping, brushing, etc.), or using a combination thereof.

Figure 2:
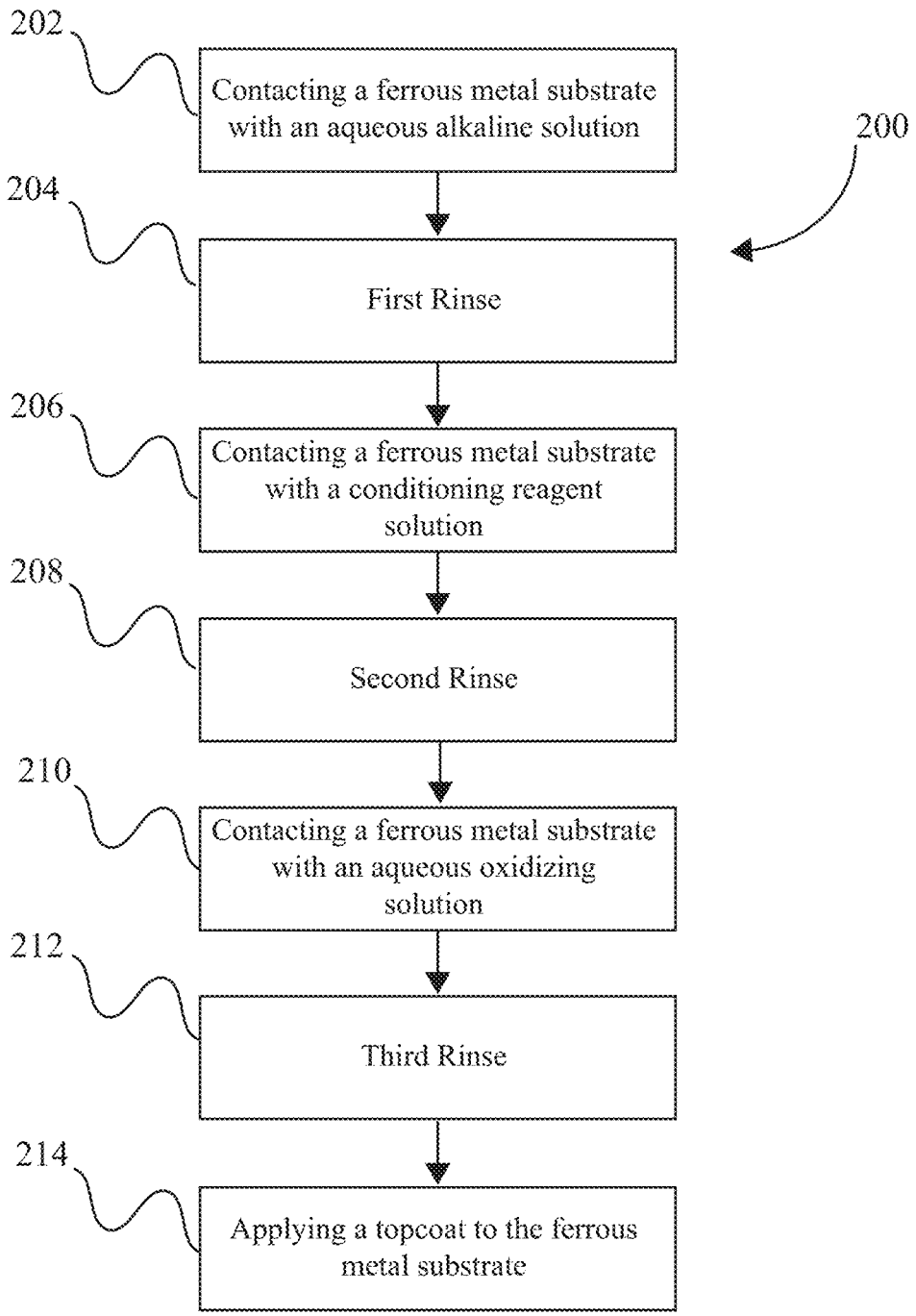
FIG. 2 is a flow chart illustrating a method in accordance with another embodiment of the invention.

Referring now to FIG. 2, a flow chart of a method 200 is shown in accordance with another embodiment of the invention. The method 200 can include pretreatment operations. For example, the method 200 can include contacting a ferrous metal substrate with an aqueous alkaline cleaning solution 202. In some embodiments, the aqueous alkaline cleaning solution can be a sodium hydroxide mixture. The aqueous alkaline cleaning solution can function to degrease and remove contaminants from the surface of the ferrous metal substrate. An exemplary aqueous alkaline cleaning solution is available as PRESTO KLEEN® HP, available from Birchwood Laboratories, Inc. (Eden Prairie, MN).

The temperature of the aqueous alkaline solution can be greater 100 degrees Fahrenheit. In some embodiments, the temperature of the aqueous alkaline solution is maintained at or above 120 degrees Fahrenheit. For example, the temperature of the aqueous alkaline solution can be from about 120 to about 140 degrees Fahrenheit. However, in some embodiments, the aqueous alkaline solution may be kept at higher temperature ranges. For example, the aqueous alkaline solution can be from about 150 to about 190 degrees Fahrenheit.

The contact time of the ferrous metal substrate with the aqueous alkaline solution can be an amount of time sufficient to degrease and remove any contaminant build up on the surface of the ferrous metal substrate. In some embodiments, the contact time can be greater than about 2 minutes. In some embodiments, the contact time can be from about 5 minutes to about 15 minutes. In some embodiments, the contact time can be from about 5 minutes to about 10 minutes.

After contacting the ferrous metal substrate with the aqueous alkaline solution, the method 200 can include a first rinse 204. The rinse can be for example, a water rinse.

Next, in some embodiments, the method 200 can include contacting the ferrous metal substrate with a conditioning reagent solution 206. However, in some embodiments, treatment with a conditioning reagent solution 206 can be omitted. After contacting with the conditioning reagent solution, the method 200 can include a second rinse 208. The rinse can be for example, a water rinse. The method 200 can then include contacting the ferrous metal substrate with an aqueous oxidizing solution 210. The method 200 can then include a third rinse 212. For example, a water rinse. In some embodiments, the method 200 can also include applying a topcoat and/or sealant 214 to the now-coated ferrous metal substrate. Details of exemplary top coating and/or sealing operations are described in greater detail below. It will be appreciated that some embodiments herein can include fewer than all of the operations described in FIG. 2. In addition, some embodiments can include additional steps beyond what is described in FIG. 2.

In various embodiments herein, a ferrous metal substrate can be contacted with various solutions, such as a conditioning reagent solution and/or an aqueous oxidizing solution. It will be appreciated that contacting a ferrous metal substrate with solutions can be performed in various ways. By way of example, in some embodiments, solutions can be applied to a substrate using techniques including immersion, spraying, fogging, rolling, brushing, wiping, dip coating, and the like.

Figure 3:
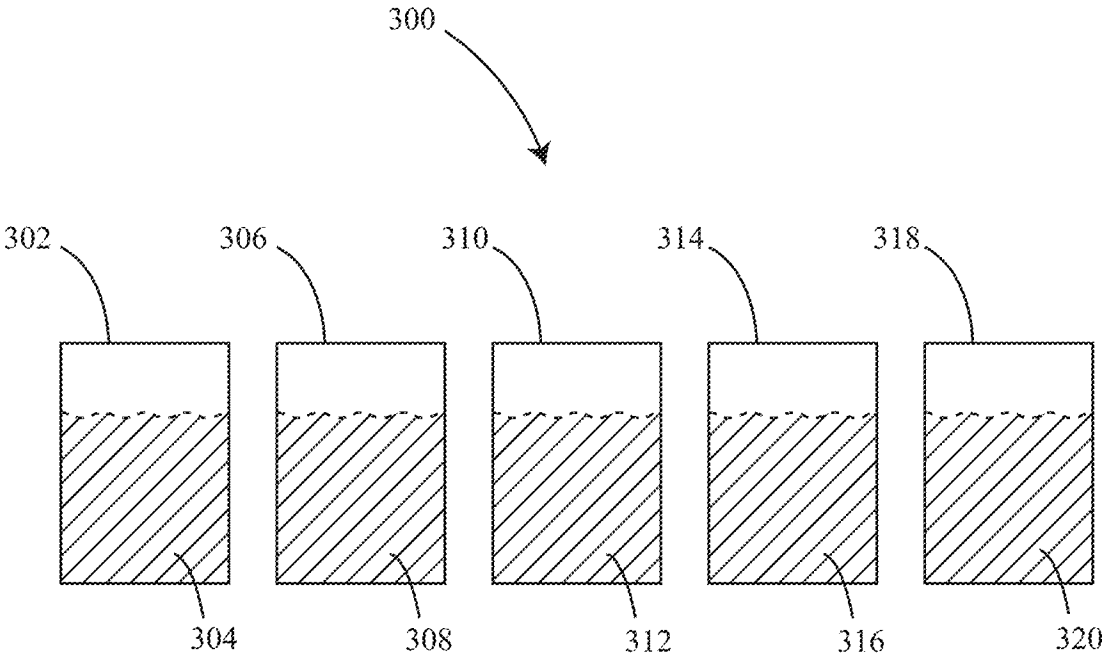
FIG. 3 is a schematic diagram illustrating a system for applying a magnetite coating to a substrate in accordance with an embodiment of the invention.

In some embodiments, a series of tanks can be arranged forming a production line and each tank can filled with a solution to facilitate a particular part of the overall coating process. Then a ferrous metal substrate can be successively dipped into each of the tanks on the production line in order to provide the ferrous substrate with the desired coating. Referring now to FIG. 3, is a schematic diagram illustrating a system 300 for forming a coating to a ferrous metal substrate in accordance with an embodiment of the invention. The system can include a first tank 302 holding a first liquid 304, a second tank 306 holding a second liquid 308, a third tank 310 holding a third liquid 312, a fourth tank 314 holding a fourth liquid 316, and a fifth tank 318 holding a fifth liquid 320. The first liquid 304 can be, for example, a conditioning reagent solution as described herein. The second liquid 308 can be, for example, water to facilitate rinsing the ferrous substrate. The third liquid 312 can be, for example, an aqueous oxidizing solution solution. The fourth liquid 316 can be, for example, water to facilitate rinsing of the ferrous substrate. The fifth liquid 320 can be, for example, a sealing or top coating solution.

In some embodiments, the system can include fewer than the seven tanks shown in FIG. 3. For example, in some systems, only two tanks may be used. Individual tanks can include other features, not shown, in order to facilitate their role in a specific part of the coating process. By way of example, some of the tanks may be provided with heating elements and a temperature controller in order to maintain the temperature of the solution inside of the tank at a desirable level. In some embodiments, the system can also include features in order to automate the coating process. By way of example, the system can include a conveying mechanism (not shown) to automatically move work pieces from one tank to another as used in the coating process.

Conditioning Reagent Solution

In some embodiments, a metal to be coated with magnetite herein can be processed using a conditioning reagent solution. However, it will be appreciated that in some embodiments this step can be omitted.

In addition to water, the conditioning reagent solution can utilize organic or inorganic water-soluble acid compounds of which a sufficient amount can be dissolved to achieve a solution pH of about 4 or less. Organic water-soluble acid compounds can include, but are not limited to, oxalic, citric, maleic, malic, glutamic, malonic, tartaric, formic, acetic, lactic, phytic, and glycolic acids, and cysteine, and their derivatives. In some embodiments, the conditioning reagent can include about 0.5 to about 100 grams per liter of organic water-soluble acid compounds.

Inorganic water-soluble acid compounds may utilize acids and acid salts that include, but are not limited to, hydrochloric, phosphoric, phosphonic and sulfuric and sulfamic acids, aluminum chloride, boron trifluoride, stannous chloride, stannic chloride and their derivatives. In some embodiments, the conditioning reagent can include about 2 to about 50% by weight of inorganic water of inorganic water-soluble acid compounds.

In some embodiments, the conditioning reagent can also include dry acid salts, at a concentration of about 20 to about 200 grams per liter. Dry acid salts can include, for example, a blend of sodium acid bisulfate, sulfamic acid, a fluoride salt, and a naphthalene sulfonate wetting agent. An exemplary dry acid salt blend is available as OXYPRIME® XP, available from Birchwood Laboratories, Inc. (Eden Prairie, MN).

In some embodiments, the conditioning reagent solution can also include a fluoride salt. The fluoride salt can enhance performance of the acid. Examples of suitable fluoride salts include but are not limited to sodium fluoride, sodium bifluoride, and ammonium bifluoride.

In some embodiments, the conditioning reagent solution can include a sequestrant to control scale and sludge build-up in the process tanks and acid-stable anionic and amphoteric surface tension reducers to promote uniform metal surface activation and rinsing. Suitable sequestrants can include but are not limited to (a) organophosphonic acids, such as aminotri-(methylene-phosphinic acid), (commercially available as Dequest 2000, Solutia Corp.), and 1-hydroxyethylene-1-diphosphonic acid (Dequest 2010), and alkali metal salts thereof and (b) hydroxycarboxylic acids, such as citric acid, tartaric acid, gluconic acid, and alkali metal salts thereof, such as sodium-potassium tartrate (Rochelle Salt). Suitable anionic surface tension reducers include but are not limited to sulfonic acids and alkali metal salts thereof such as dodecyl benzene sulfonic acid or alkylnapthalene sulfonates (commercially available as NAXAN AAL or AAP from Ruetgers-Nease or Petro AA or Petro BA from Witco Corp). Suitable amphoteric surface tension reducers include but are not limited to octyliminiodipropionic acid, commercially available as MACKAM ODP (Rhodia).

In some embodiments, the pH of the conditioning reagent solution is less than about 5.0. In some embodiments, the pH of the conditioning reagent solution is less than about 4.0.

In some embodiments the conditioning reagent solution can be formed by adding water to a vessel, then adding the other components to it. It will be appreciated though that other procedures are contemplated herein.

Aqueous Oxidizing Solution

Aqueous oxidizing solutions herein can include oxidizing agents. Exemplary oxidizing agents can include nitrate salts, such as ammonium nitrate and/or those of alkali and alkaline earth metals, such as sodium nitrate, potassium nitrate, magnesium nitrate, and the like. Oxidizing agents can further include nitrite salts, such as ammonium nitrite, and/or those of alkali and alkaline earth metals, such as sodium nitrite, calcium nitrite, and the like. In some embodiments the oxidizing agent is sodium nitrate or combinations of sodium nitrate and sodium nitrite.

It has been found that the use of the nitrate and nitrite salts specified above can be advantageous in comparison to those of the transition metal nitrate and other metal nitrate salts (examples here include ferric nitrate, zinc nitrate, aluminum nitrate, and stannous nitrate) due to their more neutral solution pH's. Transition metal nitrates and other metal nitrates tend to produce acidic solution pH's that destabilize the reducing agent component in the oxidizing bath and prevent good magnetite coating formation.

Suitable reducing agents include, but are not limited to, organic reducing agents such as mono- and disaccacharide reducing aldoses such as D-(+)-glucose,D-(+)-galactose, maltose, dextrin, cyclodextrin, and inorganic reducing agents such as sodium thiosulfate, sodium bisulfite, and sodium metabisulfite. While not intending to be bound by theory, in some embodiments, inorganic reducing agents are used as they have been observed to produce deeper black coatings than the aldoses.

In use, the oxidizing/reducing bath tends to absorb iron from the metal substrates being treated. As such, its iron concentration will gradually rise and at some point, will lead to the formation of insoluble iron precipitates.

To initiate the formation of the magnetite coating on the ferrous metal substrate, a salt can be used, such as a chloride salt and/or a tin salt. Examples of tin salts include, but are not limited to, sodium stannate, stannous chloride, stannic chloride, sodium oxalate, and the like. Examples of chloride salts include, but are not limited to, sodium chloride, calcium chloride, magnesium chloride, potassium chloride, and the like. The salt can act as a corrosion promotor to selectively oxidize the ferrous metal substrate to form a uniform, and deep black magnetite coating.

To increase the interaction between the ferrous metal substrate and the aqueous oxidizing solution, alkanolamines can be used. For example, triethanolamine. Triethanolamine can interact with the iron on the surface of the ferrous metal substrate to form a magnetite coating with greater uniformity, and a richer black color. Additionally, the presence of triethanolamine in the aqueous oxidizing solution can increase the longevity of the solution bath.

In some embodiments, the pH of the aqueous oxidizing solution can be between about 10 and 14. In some embodiments, the pH of the aqueous oxidizing solution can be between about 12 and 13.5.

In operation, the aqueous oxidizing solution can be brought to a working temperature range of about 130 to 220 degrees Fahrenheit. In some embodiments, the aqueous oxidizing solution can be brought to a working temperature range of about 190 to 210 degrees Fahrenheit. In some embodiments, contact times can vary from about 5 to about 45 minutes. In some embodiments, contact times can vary from about 15 to about 30 minutes.

An embodiment of the aqueous oxidizing solution includes the following components:

TABLE 1

| | |
|---|---|
| Sodium hydroxide (NaOH) | 70-190 grams per liter |
| Sodium nitrite ($NaNO_2$) | 3-30 grams per liter |
| Sodium nitrate ($NaNO_3$) | 2-80 grams per liter |
| Sodium stannate ($Na_2O_3Sn$) | 0.1-10 grams per liter |
| Sodium molybdate ($Na_2MoO_4$) | 0.01-5 grams per liter |
| Sodium thiosulfate ($Na_2S_2O_3$) | 2-15 grams per liter |
| Sodium chloride (NaCl) | 3-120 grams per liter |
| Triethanolamine ($C_6H_{15}NO_3$) | 0.1-15 grams per liter |
| Potassium thiocyanate (KSCN) | 0.1-5 grams per liter |
| EDTA Chelating Agent | 0.1-5 grams per liter |

Another embodiment of the aqueous oxidizing solution includes the following components:

TABLE 2

| | |
|---|---|
| Sodium hydroxide (NaOH) | 100-160 grams per liter |
| Sodium nitrite ($NaNO_2$) | 5-20 grams per liter |
| Sodium nitrate ($NaNO_3$) | 10-50 grams per liter |
| Sodium stannate ($Na_2O_3Sn$) | 1-4 grams per liter |
| Sodium molybdate ($Na_2MoO_4$) | 0.1-2 grams per liter |
| Sodium thiosulfate ($Na_2S_2O_3$) | 4-8 grams per liter |
| Sodium chloride (NaCl) | 10-75 grams per liter |
| Triethanolamine ($C_6H_{15}NO_3$) | 1-7 grams per liter |
| Potassium thiocyanate (KSCN) | 0.25-2 grams per liter |
| EDTA Chelating Agent | 0.25-2 grams per liter |

A particular embodiment of the aqueous oxidizing solution comprises no less than about the following amounts:

TABLE 3

| | |
|---|---|
| Sodium hydroxide (NaOH) | about 130 grams per liter |
| Sodium nitrite ($NaNO_2$) | about 13 grams per liter |
| Sodium nitrate ($NaNO_3$) | about 26 grams per liter |
| Sodium stannate ($Na_2O_3Sn$) | about 2.5 grams per liter |
| Sodium molybdate ($Na_2MoO_4$) | about 1 gram per liter |
| Sodium thiosulfate ($Na_2S_2O_3$) | about 7 grams per liter |
| Sodium chloride (NaCl) | about 40 grams per liter |
| Triethanolamine ($C_6H_{15}NO_3$) | about 5 grams per liter |
| Potassium thiocyanate (KSCN) | about 1 gram per liter |
| EDTA Chelating Agent | about 1 gram per liter |

In other embodiments, the aqueous oxidizing solution can be a concentrate solution that can be diluted by a consumer. The concentrate can be diluted by about 40 to about 60 percent. In some embodiments, the concentrate can be diluted by about 50 percent. The concentrate of the aqueous oxidizing solution includes the following components:

TABLE 4

| | |
|---|---|
| Sodium hydroxide (NaOH) | 140-380 grams per liter |
| Sodium nitrite ($NaNO_2$) | 6-60 grams per liter |
| Sodium nitrate ($NaNO_3$) | 4-160 grams per liter |
| Sodium stannate ($Na_2O_3Sn$) | 0.2-20 grams per liter |
| Sodium molybdate ($Na_2MoO_4$) | 0.02-10 grams per liter |
| Sodium thiosulfate ($Na_2S_2O_3$) | 4-30 grams per liter |
| Sodium chloride (NaCl) | 6-240 grams per liter |
| Triethanolamine ($C_6H_{15}NO_3$) | 0.2-30 grams per liter |
| Potassium thiocyanate (KSCN) | 0.2-10 grams per liter |
| EDTA Chelating Agent | 0.2-10 grams per liter |

Another embodiment of the aqueous oxidizing solution concentrate includes the following components:

TABLE 5

| | |
|---|---|
| Sodium hydroxide (NaOH) | 200-320 grams per liter |
| Sodium nitrite ($NaNO_2$) | 10-40 grams per liter |
| Sodium nitrate ($NaNO_3$) | 20-100 grams per liter |
| Sodium stannate ($Na_2O_3Sn$) | 2-8 grams per liter |
| Sodium molybdate ($Na_2MoO_4$) | 0.2-4 grams per liter |
| Sodium thiosulfate ($Na_2S_2O_3$) | 8-16 grams per liter |
| Sodium chloride (NaCl) | 20-150 grams per liter |
| Triethanolamine ($C_6H_{15}NO_3$) | 2-14 grams per liter |
| Potassium thiocyanate (KSCN) | 0.5-4 grams per liter |
| EDTA Chelating Agent | 0.5-4 grams per liter |

A particular embodiment of the aqueous oxidizing solution concentrate comprises no less than about the following amounts:

TABLE 6

| | |
|---|---|
| Sodium hydroxide (NaOH) | about 260 grams per liter |
| Sodium nitrite ($NaNO_2$) | about 26 grams per liter |
| Sodium nitrate ($NaNO_3$) | about 52 grams per liter |
| Sodium stannate ($Na_2O_3Sn$) | about 5 grams per liter |
| Sodium molybdate ($Na_2MoO_4$) | about 2 grams per liter |
| Sodium thiosulfate ($Na_2S_2O_3$) | about 14 grams per liter |
| Sodium chloride (NaCl) | about 80 grams per liter |
| Triethanolamine ($C_6H_{15}NO_3$) | about 10 grams per liter |
| Potassium thiocyanate (KSCN) | about 2 grams per liter |
| EDTA Chelating Agent | about 2 grams per liter |

Ferrous Metal Substrates

Ferrous metal substrates as used with embodiments herein can include substrates made of pure iron as well as iron alloys. Exemplary ferrous metal substrates can include, but are not limited to, iron, wrought iron, cast iron, pig iron, steel (such as carbon steel, alloy steel, stainless steel, tool steel, maraging steel) and the like. The ferrous metal substrates can take on any shape desired for end use include bars, castings, extrusions, sheets, screens, blocks, iron elbows, steel hinges, slotted cold rolled steel stampings, forged tie rod end, cinch ring, tool sockets, heat treated end caps, and the like.

Substrate Pretreatment

In some embodiments the ferrous metal substrate may be subjected to a pretreating operation before other processing steps such as treatment with the first solution. Pretreatment can function to remove contaminants from the ferrous metal substrate surface such as residual oils and other compounds left over from metal processing steps. In some embodiments, pretreatment can also be used to remove iron oxide from the surface of the ferrous metal substrate.

Exemplary pretreating operations can specifically include abrasive cleaning, alkaline cleaning, and/or acid etching. By way of example, in some embodiments the ferrous metal substrate can be pretreated by sanding with an abrasive such as sandpaper. In some embodiments, the ferrous metal substrate can be pretreated by sand blasting. In some embodiments, the ferrous metal substrate can be washed with an alkaline cleaning solution.

For example, the ferrous metal substrate can be washed with a solution having a pH of greater than 7, such as an aqueous solution including alkaline detergent builders and surface tension reducers. In some embodiments, the ferrous metal substrate can be washed with an acidic cleaning solution.

Topcoating and/or Sealing

In some embodiments the ferrous metal substrate may be subjected to a top coating and/or sealing operation after other steps of the process have been performed. Top coating of the ferrous metal substrate can function to improve the aesthetic properties of the finish as well as increase corrosion resistance, improve color stability, and improve the adherence of the newly applied black coating. Top coating and/or sealing can be formed by applying a top coating solution to the ferrous metal substrate. Exemplary top coating solutions can include an oil, polymer, and/or other film former appropriate to the end use of the article. In some embodiments, the substrate can be further processed with an oil emulsion in order to provide enhanced corrosion resistance.

The present invention may be better understood with reference to the following examples. These examples are intended to be representative of specific embodiments of the invention, and are not intended as limiting the scope of the invention.

EXAMPLES

Example 1: Comparative Analysis of Prior Art Vs. Embodiment of Solution Herein U.S. Pat. No. 6,309,476 details an aqueous oxidizing solution which will promote the formation of a magnetite coating on ferrous metals. The patent specifies that after an additional pre-treatment, the steel is immersed in an aqueous oxidizing solution at 200° F. to produce a magnetite coating. The aqueous oxidizing solution specified in U.S. Pat. No. 6,309,476 contains ("solution 1"):

TABLE 7

| | |
|---|---|
| Sodium Hydroxide | 100 g/l |
| Sodium Nitrite | 5 g/l |
| Sodium Nitrate | 35 g/l |
| Stannous Chloride | 0.2 g/l |
| Sodium Molybdate | 5 g/l |
| Sodium Thiosulfate | 5 g/l |
| Petro AA | 0.1 g/l |
| Water | |

Figure 4:
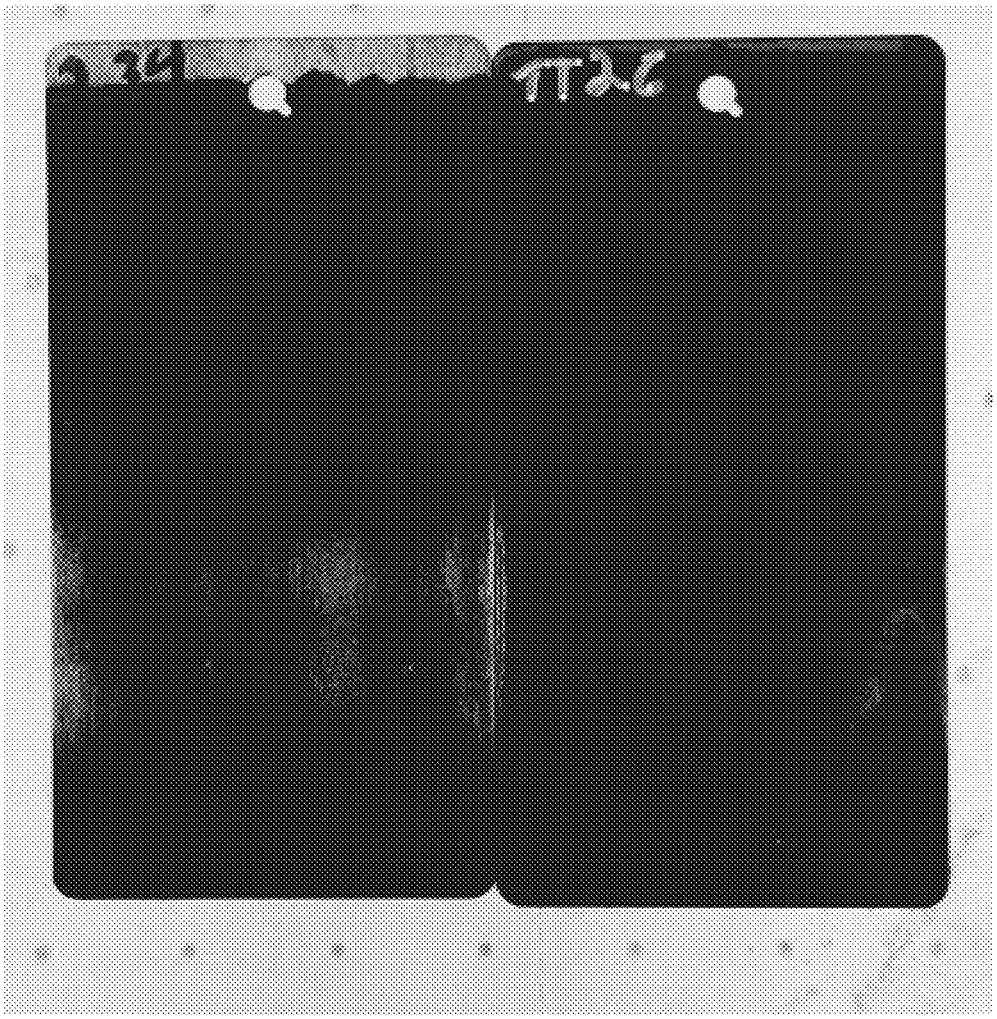
FIG. 4 is a picture showing a comparison showing the effects of a prior art solution and a solution in accordance with embodiments herein.

This solution was evaluated using the following techniques:

A low alloy carbon steel panel was cleaned by conventional means, rinsed, and pickled in a mineral acid for 10 minutes at room temperature. After rinsing, the article was immersed for 15 minutes at 200° F. in solution 1. The panel took on a black color due to the formation of magnetite on the surface. (FIG. 4, left side)

Figure 5:
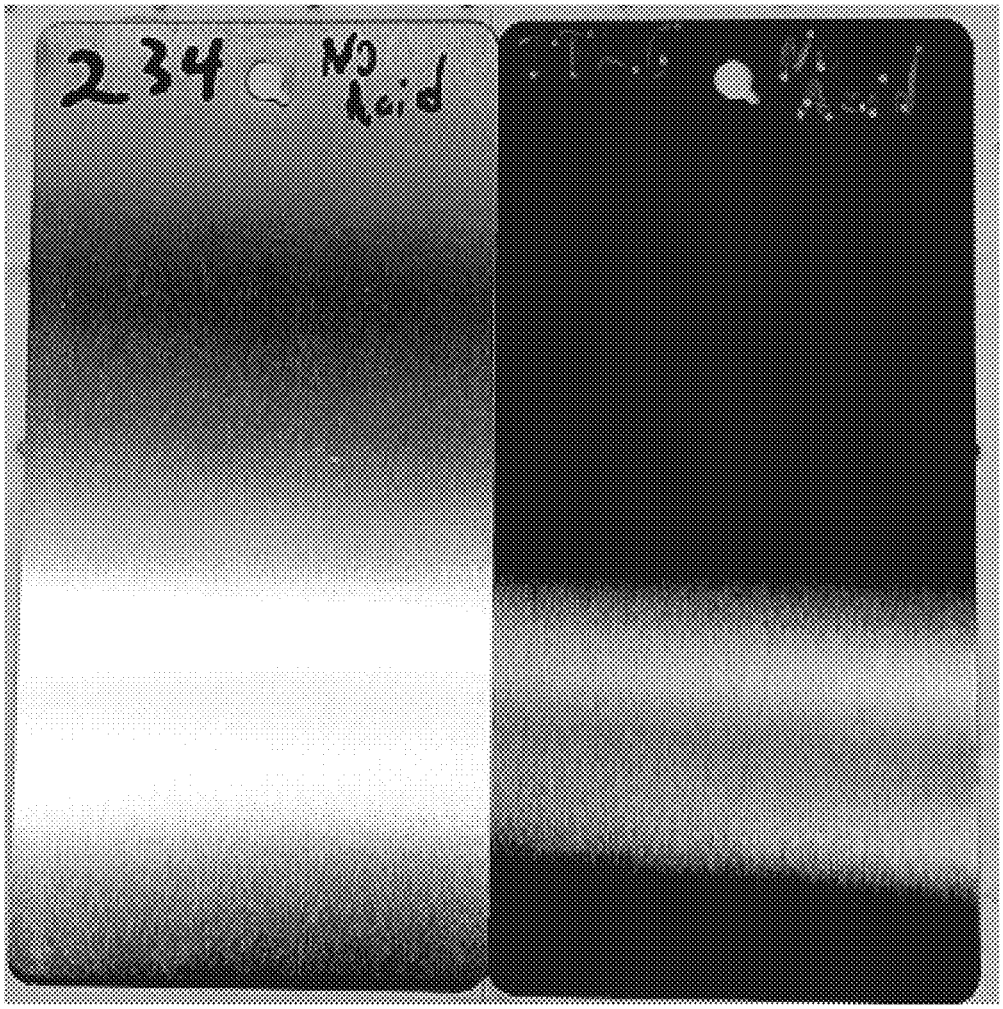
FIG. 5 is a picture showing a comparison showing the effects of a prior art solution and a solution in accordance with embodiments herein.

A low alloy carbon steel panel was cleaned by conventional means, rinsed, and without pickling in a mineral acid, the article was immersed for 15 minutes at 200° F. in solution 1. The panel did not show any change in color nor has any changes on the surface due to a magnetite coating. (FIG. 5, left side)

Figure 6:
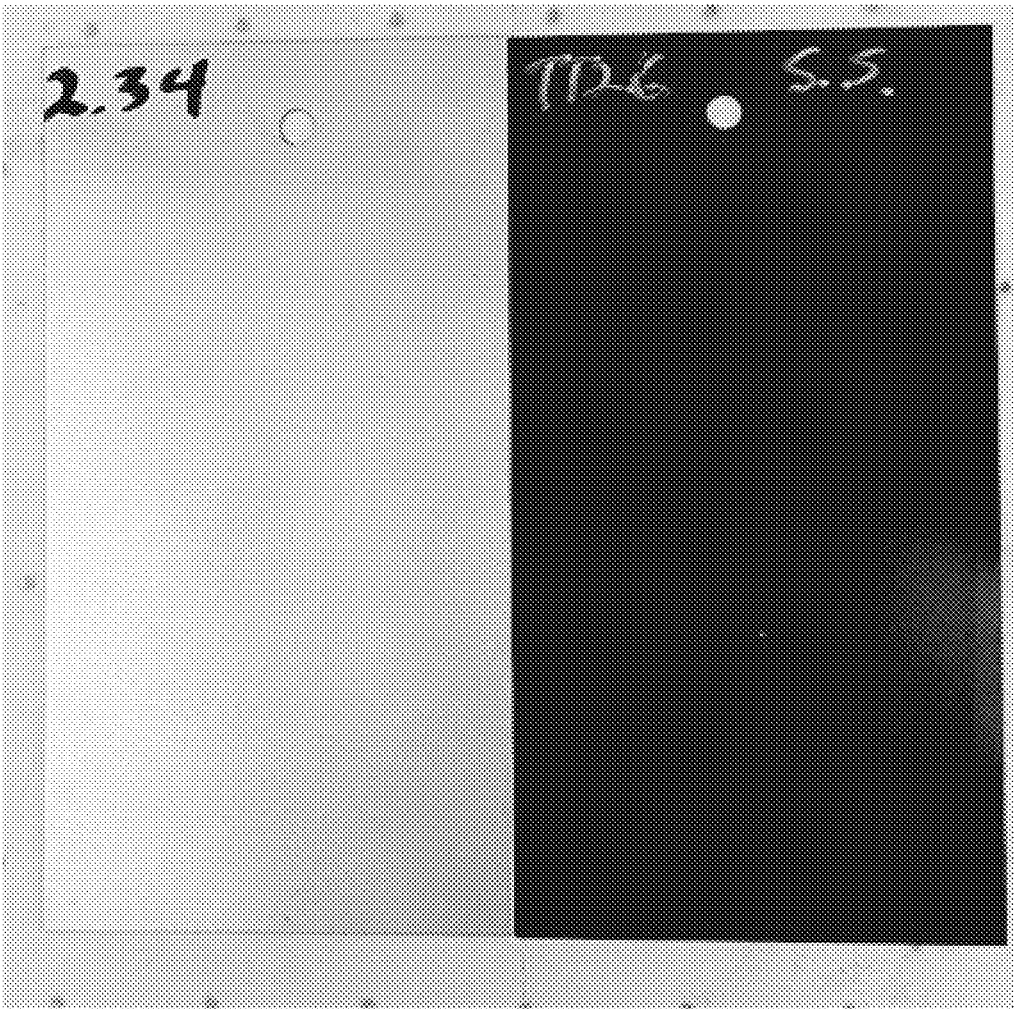
FIG. 6 is a picture showing a comparison showing the effects of a prior art solution and a solution in accordance with embodiments herein.

A 304 stainless steel panel was media blasted, cleaned by conventional means and pickled in a mineral acid for 10 minutes at room temperature. After rinsing, the article was immersed for 15 minutes at 200° F. in solution 1. The panel did not show any change in color nor has any changes on the surface due to a magnetite coating. (FIG. 6, left side)

To compare the results obtained with solution 1 with an embodiment herein, a solution was prepared with the following composition ("solution 2").

TABLE 8

| | |
|---|---|
| Sodium Hydroxide | 130 g/l |
| Sodium Nitrite | 13 g/l |
| Sodium Nitrate | 26 g/l |
| Sodium Stannate | 2.5 g/l |
| Sodium Molybdate | 1 g/l |
| Sodium Thiosulfate | 7 g/l |
| Sodium Chloride | 40 g/l |
| Triethanolamine | 5 g/l |
| Potassium Thiocyanate | 1 g/l |
| Ethylenediamine-tetraacetic acid | 1 g/l |
| Water | |

This solution was evaluated using the following techniques:

A low alloy carbon steel panel was cleaned by conventional means, rinsed, and pickled in a mineral acid for 10 minutes at room temperature. After rinsing, the article was immersed for 15 minutes at 200° F. in solution 2. The panel took on a dark black color clue to the formation of magnetite on the surface. (FIG. 4, right side)

A low alloy carbon steel panel is cleaned by conventional means, rinsed, and without pickling in a mineral acid, the article was immersed for 15 minutes at 200° F. in solution 2. The panel took on a shiny black color due to the formation of magnetite on the surface. (FIG. 5, right side)

A 304 stainless steel panel was media blasted, cleaned by conventional means and pickled in a mineral acid for 10 minutes at room temperature. After rinsing, the article was immersed for 15 minutes at 200° F. in solution 2. The panel took on a uniform black color due to the formation of magnetite on the surface. (FIG. 6, right side)

This example shows the superior performance of solutions in accordance with embodiments herein. Specifically, unlike the prior art solution tested, the solution in accordance with embodiments herein was able to generate a deep black coating on a low alloy carbon steel panel even without pickling in a mineral acid. Further, unlike the prior art solution tested, the solution in accordance with embodiments herein was able to generate a deep black coating on a stainless steel panel.

Example 2: Comparative Analysis of Prior Art Vs. Embodiment of Solution Herein The new invention is able to produce a magnetite coating within a range of constituents. The range for the aqueous oxidizing solution is as follows:

TABLE 9

| | |
|---|---|
| Sodium Hydroxide | 70-190 g/l |
| Sodium Nitrite | 3-30 g/l |
| Sodium Nitrate | 2-80 g/l |
| Sodium Stannate | 0.1-10 g/l |
| Sodium Molybdate | 0.01-5 g/l |
| Sodium Thiosulfate | 2-15 g/l |
| Sodium Chloride | 3-120 g/l |
| Triethanolamine | 0.1-15 g/l |
| Potassium Thiocyanate | 0.1-5 g/l |
| Ethylenediamine-tetraacetic acid | 0.1-5 g/l |
| Water | |

A series of tests were performed with solutions varying in composition. The composition of the aqueous oxidizing solutions 3-11 are summarized in table 10 below. All values are in grams/liter.

TABLE 10

| | S3 | S4 | S5 | S6 | S7 | S8 | S9 | S10 | S11 |
|---|---|---|---|---|---|---|---|---|---|
| Sodium Hydroxide | 160 | 100 | 80 | 110 | 100 | 260 | 140 | 145 | 145 |
| Sodium Nitrite | 30 | 13 | 13 | 20 | 50 | 30 | 10 | 15 | 6 |
| Sodium Nitrate | 20 | 26 | 26 | 20 | 10 | 44 | 35 | 32 | 15 |
| Sodium Stannate | 2.5 | 2.5 | 2.5 | 1 | 2.5 | 2 | 1.5 | 4 | 1.5 |
| Sodium Molybdate | 1 | 1 | 1 | 1 | 1 | 1 | 0.7 | 2 | 0.7 |
| Sodium Thiosulfate | 7 | 7 | 7 | 5 | 7 | 10 | 5 | 8 | 4 |
| Sodium Chloride | 40 | 100 | 40 | 20 | 40 | 100 | 50 | 75 | 60 |
| Triethanolamine | 5 | 3 | 5 | 3 | 5 | 6 | 2 | 1 | 7 |
| Potassium Thiocyanate | 1 | 1 | 1 | 2 | 1 | 0 | 1 | 1.5 | 0.5 |
| Ethylenediaminetetraacetic acid | 1 | 1 | 1 | 2 | 1 | 0 | 1 | 1.5 | 0.5 |
| Water | | | | | | | | | |

Solutions 3-9: A low alloy carbon steel panel was cleaned by conventional means, rinsed, and pickled in a mineral acid for 10 minutes at room temperature. After rinsing, the article was immersed for 15 minutes at 200° F. The panel took on a dark black color due to the formation of magnetite on the surface.

Solution 10: A low alloy carbon steel panel was cleaned by conventional means, rinsed, and without pickling in a mineral acid, the article was immersed for 15 minutes at 200° F. The panel took on a shiny black color due to the formation of magnetite on the surface.

Solution 11: A 304 stainless steel article was cleaned by conventional means and pickled in a mineral acid for 10 minutes at room temperature. After rinsing, the article was immersed for 15 minutes at 200° F. The panel took on a dark black color due to the formation of magnetite on the surface.

This example shows that a range of different specific formulations falling within the bounds herein can be successfully used to apply magnetite coatings on metal surfaces.

The embodiments described herein are not intended to be exhaustive or to limit the invention to the precise forms disclosed in the following detailed description. Rather, the embodiments are chosen and described so that others skilled in the art can appreciate and understand the principles and practices. As such, while aspects have been described with reference to various specific and preferred embodiments and techniques, it should be understood that many variations and modifications may be made while remaining within the spirit and scope herein.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

The invention claimed is:

1. A composition for forming a magnetite coating on a ferrous metal substrate comprising:

an aqueous oxidizing solution, the aqueous oxidizing solution comprising an alkali metal hydroxide;

an alkanolamine; and a chloride salt;

wherein the aqueous oxidizing solution has a pH above 10.0.

2. The composition of claim 1, wherein the aqueous oxidizing solution has a pH above 13.0.

3. The composition of claim 1, wherein the aqueous oxidizing solution comprises about 70 to about 190 grams per liter of the alkali metal hydroxide and/or about 30 parts to about 85 parts of the alkali metal hydroxide per 100 parts of non-aqueous components of the composition.

4. The composition of claim 1, wherein the aqueous oxidizing solution comprises about 0.1 to about 15 grams per liter of the alkanolamine.

5. The composition of claim 1, wherein the aqueous oxidizing solution comprises about 0.01 parts to about 7 parts of the alkanolamine per 100 parts of non-aqueous components of the composition.

6. The composition of claim 1, wherein the aqueous oxidizing solution comprises about 3 to about 120 grams per liter of the chloride salt and/or about 1 part to about 54 parts of the chloride salt per 100 parts of non-aqueous components of the composition.

7. The composition of claim 1, the alkali metal hydroxide comprising sodium hydroxide.

8. The composition of claim 1, the alkanolamine comprising triethanolamine.

9. The composition of claim 1, the chloride salt comprising sodium chloride.

10. The composition of claim 1, the aqueous oxidizing solution comprising a molybdate salt.

11. The composition of claim 10, wherein the aqueous oxidizing solution comprises about 0.01 to about 5 grams per liter of the molybdate salt and/or about 0 parts to about 3 parts of the molybdate salt per 100 parts of non-aqueous components of the composition.

12. The composition of claim 10, the molybdate salt comprising sodium molybdate.

13. The composition of claim 1, the aqueous oxidizing solution comprising a tin salt.

14. The composition of claim 13, the tin salt comprising sodium stannate.

15. The composition of claim 14, wherein the aqueous oxidizing solution comprises about 0.1 to about 10 grams per liter sodium stannate and/or about 0.01 parts to about 5 parts of sodium stannate per 100 parts of non-aqueous components of the composition.

16. The composition of claim 1, the aqueous oxidizing solution comprising:

about 70 to about 190 grams per liter sodium hydroxide;
about 3 to about 30 grams per liter of an alkali metal nitrite;
about 2 to about 80 grams per liter of an alkali metal nitrate;
about 0.1 to about 10 grams per liter of a tin salt;
about 0.01 to about 5 grams per liter sodium molybdate;
about 2 to about 15 grams per liter of an alkali metal thiosulfate;
about 3 to about 120 grams per liter sodium chloride;
about 0.1 to about 15 grams per liter triethanolamine;
about 0.1 to about 5 grams per liter potassium thiocyanate; and
about 0.1 to about 5 grams per liter of an EDTA chelating agent.

17. The composition of claim 1, the aqueous oxidizing solution comprising:

about 30 parts to about 85 parts sodium hydroxide;
about 1 part to about 14 parts of an alkali metal nitrite;
about 0.5 parts to about 35 parts of an alkali metal nitrate;
about 0.01 parts to about 5 parts of a tin salt;
about 0.01 parts to about 3 parts sodium molybdate;
about 0.5 parts to about 7 parts of an alkali metal thiosulfate;
about 1 part to about 54 parts sodium chloride;
about 0.01 parts to about 7 parts triethanolamine;
about 0.01 parts to about 3 parts potassium thiocyanate; and
about 0.01 parts to about 3 parts of an EDTA chelating agent.

18. A composition for forming a magnetite coating on a ferrous metal substrate comprising:

an aqueous oxidizing concentrate, the aqueous oxidizing concentrate comprising
an alkali metal hydroxide;
an alkanolamine; and
a chloride salt;
wherein the aqueous oxidizing concentrate comprises about 0.1 to about 15 grams per liter of the alkanolamine.

19. The composition of claim 18, the aqueous oxidizing concentrate comprising:

about 140 to about 380 grams per liter sodium hydroxide;
about 6 to about 60 grams per liter of an alkali metal nitrite;
about 4 to about 160 grams per liter of an alkali metal nitrate;
about 0.2 to about 20 grams per liter of a tin salt;
about 0.02 to about 10 grams per liter sodium molybdate;
about 4 to about 30 grams per liter of an alkali metal thiosulfate;
about 6 to about 240 grams per liter sodium chloride;
about 0.2 to about 30 grams per liter triethanolamine;
about 0.2 to about 10 grams per liter potassium thiocyanate; and
about 0.2 to about 10 grams per liter of an EDTA chelating agent.

20. A composition for forming a magnetite coating on a ferrous metal substrate comprising:

an aqueous oxidizing solution, the aqueous oxidizing solution comprising
an alkali metal hydroxide;
an alkanolamine;
a chloride salt; and
a molybdate salt;
wherein the aqueous oxidizing solution comprises about 0.01 to about 5 grams per liter of the molybdate salt and/or about 0 parts to about 3 parts of the molybdate salt per 100 parts of non-aqueous components of the composition.

* * * * *